US005081495A

United States Patent [19]

Bellis

[11] Patent Number: 5,081,495

[45] Date of Patent: Jan. 14, 1992

[54] IMAGE FORMING APPARATUS USING AN IMAGE MEMBER CARTRIDGE HAVING A SOURCE OF OFFSET PREVENTING LIQUID

[75] Inventor: Edson F. Bellis, Macedon, N.Y.

[73] Assignee: Eastman Kodak Company, Rochester, N.Y.

[21] Appl. No.: 680,715

[22] Filed: Apr. 4, 1991

[51] Int. Cl.[5] ..... G03G 5/00; G03G 15/048; G03G 15/20

[52] U.S. Cl. ..... 355/211; 118/256; 355/284; 355/326

[58] Field of Search ..... 355/200, 210, 211, 271, 355/282, 284, 326, 327; 118/256, 257, 258, 259, 260, 261, 262, 263, 264, 265, 266, 267, 268, 269

[56] References Cited

U.S. PATENT DOCUMENTS

| | | | |
|---|---|---|---|
| 4,530,588 | 7/1985 | Kimura et al. | 355/211 |
| 4,591,258 | 5/1986 | Nishino et al. | 355/200 |
| 4,757,342 | 7/1988 | Ogura et al. | 355/211 |
| 4,876,577 | 10/1989 | Ogura et al. | 355/315 |
| 4,905,049 | 2/1990 | Bickerstaff et al. | 355/284 |
| 4,975,743 | 12/1990 | Surti | 355/211 |
| 4,994,862 | 2/1991 | Hoover | 355/284 |

*Primary Examiner*—A. T. Grimley
*Assistant Examiner*—Sandra L. Brase
*Attorney, Agent, or Firm*—Leonard W. Treash, Jr.

[57] ABSTRACT

An image forming apparatus is supplied with an image member contained in a replaceable cartridge. The image forming apparatus includes a fuser requiring offset preventing liquid. The image member cartridge includes a source of offset preventing liquid accessible to the fuser.

27 Claims, 5 Drawing Sheets

IMAGE FORMING APPARATUS USING AN IMAGE MEMBER CARTRIDGE HAVING A SOURCE OF OFFSET PREVENTING LIQUID

TECHNICAL FIELD

This invention relates to image forming apparatus of the type which form a toner image on an image member supplied to the image forming apparatus in a cartridge, and, more specifically, to such an apparatus in which the toner image is transferred to a receiving sheet and fused by a fuser that requires a supply of offset preventing liquid.

BACKGROUND ART

U.S. Pat. Nos. 4,876,577 and 4,591,258 are typical of a number of references showing a cartridge containing a rotatable photoconductive drum with charging and cleaning stations also within the cartridge. The cartridge is received in an image forming apparatus which rotates the drum to bring it past the charging station within the cartridge where an image surface associated with the drum is uniformly charged. An access opening permits exposure of the charged image surface to create an electrostatic image. The electrostatic image is toned by application of toner either from a toning station within the cartridge or through a toning access opening by a development station located in the receiving apparatus. Each toner image formed by such toning is then transferred to a receiving sheet which is electrostatically held to a portion of the surface of the image member. The receiving sheet is then fed to a heated pressure roller fuser where the toner image is fused to the receiving sheet.

Such image member cartridges have been adopted commercially for personal copiers and laser printers. The replacement of the image member also removes residual toner and supplies a new charger to the apparatus. Thus, it replaces in a single step several items separately serviced by a repair personnel in larger, more heavy-duty apparatus.

Such apparatus still requires separate servicing of the fuser. Typically, a fusing wick containing offset preventing liquid is replaced in the fuser by the operator each time an image member cartridge is loaded in the apparatus.

STATEMENT OF THE INVENTION

It is an object of the invention to further simplify the supply of materials to an image forming apparatus using a replaceable image member cartridge.

These and other objects are accomplished by supplying the offset preventing liquid to the apparatus as part of a replaceable image member cartridge.

According to a preferred embodiment, an image forming apparatus includes means for receiving a cartridge containing a source of offset preventing liquid and an image member having an image surface. The apparatus includes means for moving the image member through an endless path past a series of stations for forming a toner image on the image surface. A transfer means transfers the toner image to a receiving sheet and a fuser fuses the toner image to the sheet. The fuser includes means for applying an offset preventing liquid to the surface of the fuser. The image forming apparatus includes means for transporting an offset preventing liquid from the source of such liquid in the cartridge to the liquid applying means of the fuser.

Also, according to a preferred embodiment of the invention an image member cartridge is provided which includes an image member and a source of offset preventing liquid for the fuser of a receiving image forming apparatus.

According to a further preferred embodiment, the image member cartridge is insertable in the image forming apparatus in a two movement insertion operation. The cartridge is first inserted by movement parallel to the axis of the image member until it is located at its full depth in the apparatus. As part of this movement, a valve means for supplying offset preventing liquid from the source in said cartridge mates with a complementary valve forming part of the image forming apparatus. The cartridge is then rotated to move the image member into transfer relation with a transfer means. The receiving valve in the image forming apparatus is movable to accept movement of the complementary valve means in the cartridge as part of this last rotation. The receiving valve means is connectable to the liquid applying means of the fuser.

With this structure the operator does not need to go through a separate step servicing the fuser when an image member cartridge is supplied to the apparatus. The offset preventing liquid for the fuser is supplied to the apparatus as part of the image member cartridge loading operation. It also facilitates the use of a liquid reservoir in such image forming apparatus where convenience in the prior art encouraged only replacement of a release liquid wetted wick. This feature fits with use of cartridge image member replacement in larger machines and with image members usable for a much longer life.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENTS

Figure 1:
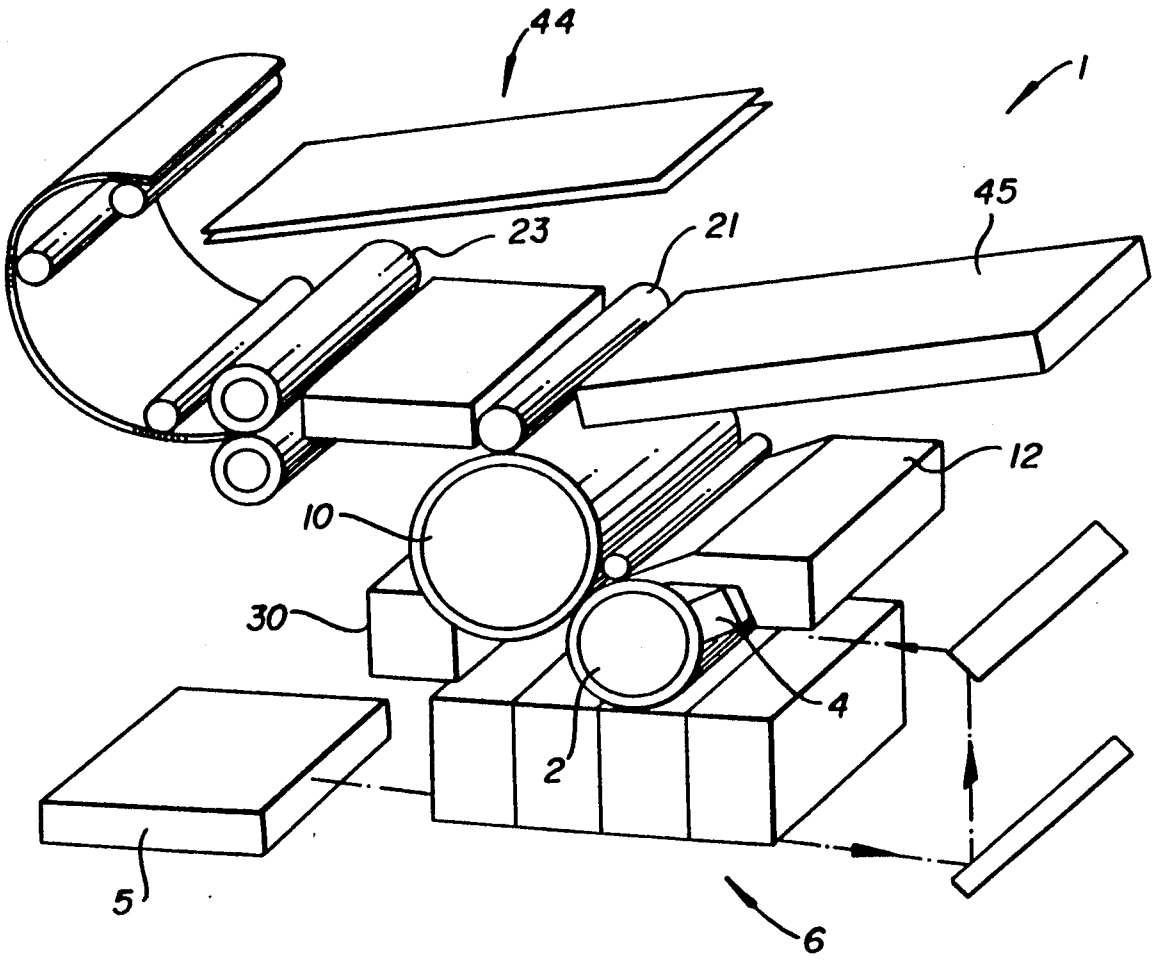
FIG. 1 is a perspective schematic of an image forming apparatus in which the invention is usable showing basic component parts with many parts and virtually all housing structure eliminated for clarity of illustration.
Figure 2:
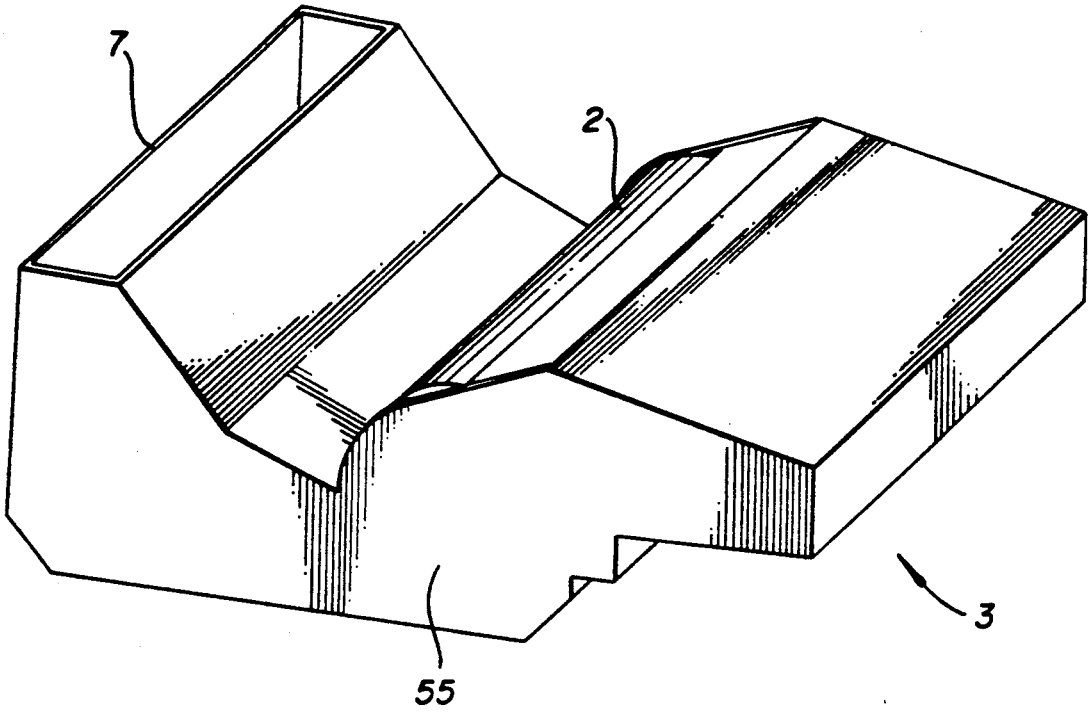
FIG. 2 is a front perspective view of an image member cartridge loadable in the apparatus shown in FIG. 1.

The invention is particularly usable in an image forming apparatus, for example, a printer 1 shown in FIG. 1. Printer 1 includes an image member, for example, a photoconductive drum 2 which is journaled for rotation past a series of stations including a charging station 4 which lays down a uniform charge on an outer cylindrical image surface of image member 2. The uniformly charged image surface is imagewise exposed by a laser 5 to form a series of electrostatic images. The electrostatic images are toned by applying toners of different colors by a development device 6 to create a series of different color toner images on the image surface of image member 2. The different color toner images are transferred in registration to the outside surface of a transfer drum 10 to form a multicolor image as transfer drum 10 repeatedly rotates through transfer relation with image member 2. The multicolor toner image on the surface of transfer drum 10 is transferred to a receiving sheet fed from a receiving sheet supply 45 into transfer relation with drum 10 at a transfer station 21. The receiving sheet is then fed to a fuser 23 where the multicolor image is fused to the transfer sheet by the application of heat and pressure using a conventional heated pressure roller fuser. The receiving sheet with the fixed toner image thereon is then conveyed through an inverting path to an output hopper already containing other receiving sheets as shown at 44. The transfer drum 10 is cleaned by an articulatable cleaner 30 after transfer of images. The photoconductive drum 2 is continuously cleaned by an image member cleaning device 12.

Figure 3:
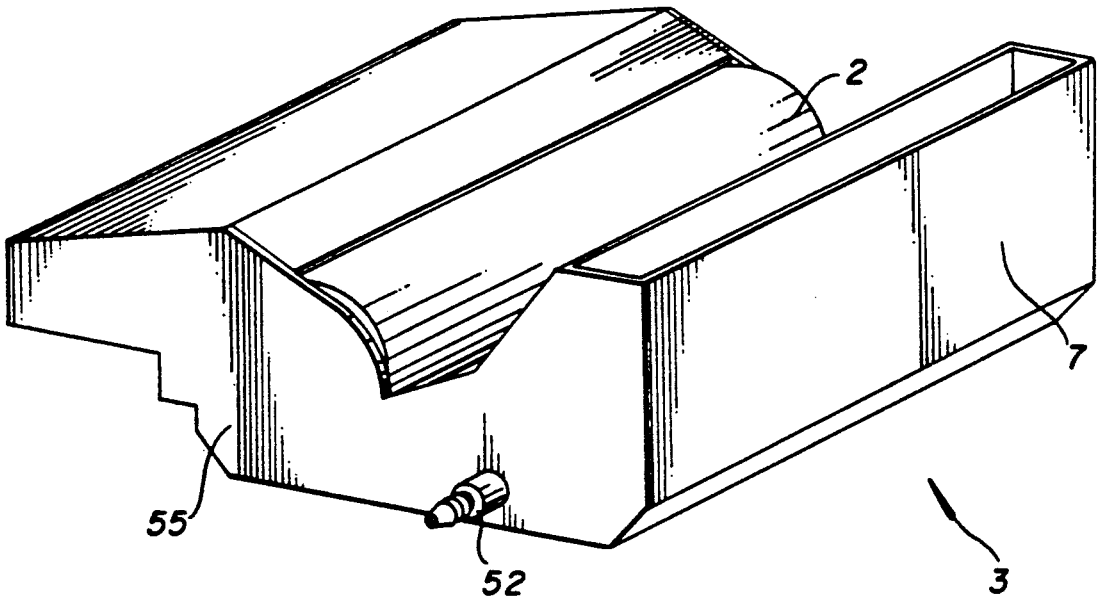
FIG. 3 is a rear perspective view of the cartridge shown in FIG. 2.
Figure 4:
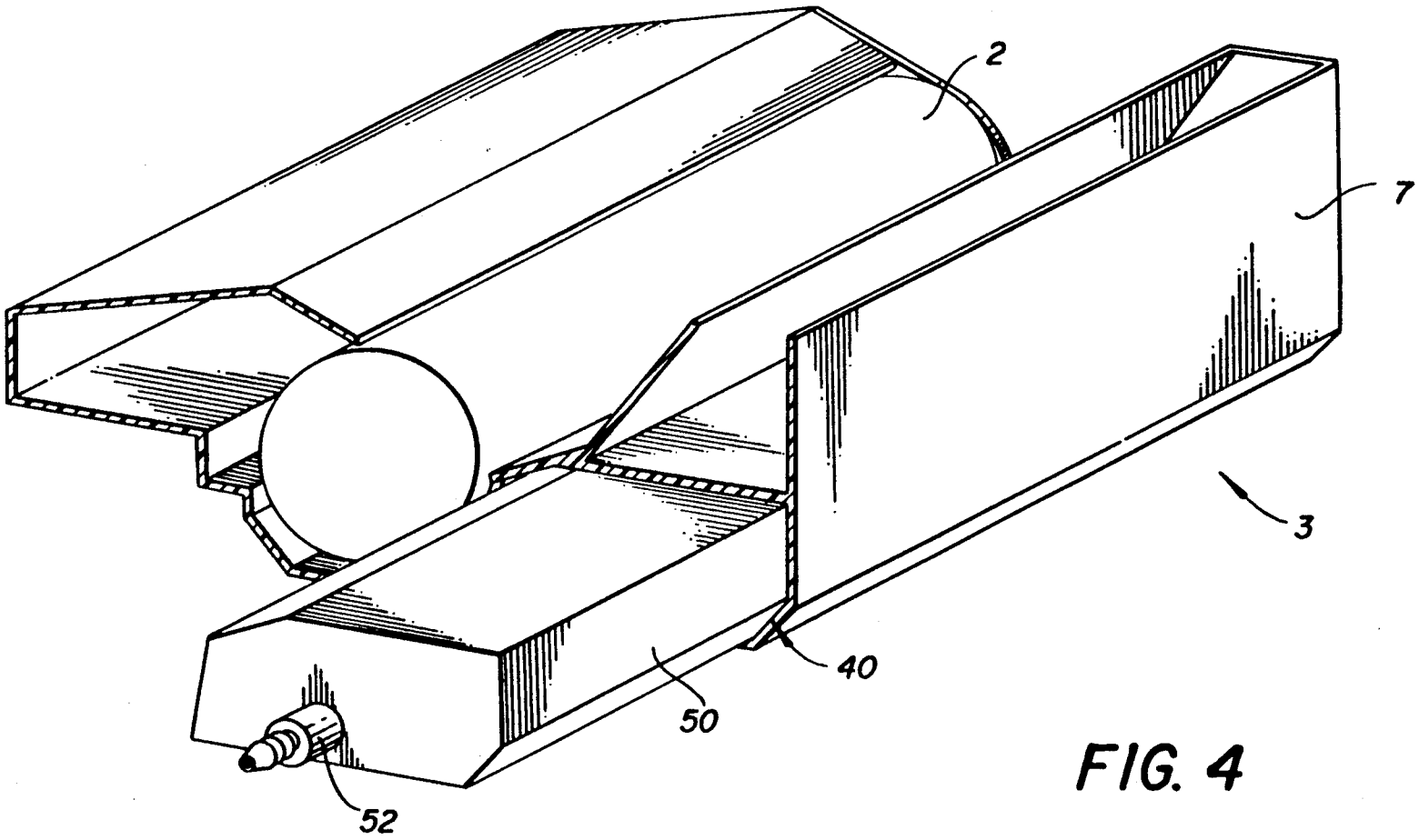
FIG. 4 is a rear perspective similar to that of FIG. 3 but with a rear wall eliminated and an oil bottle partly inserted in the cartridge.
Figure 5:
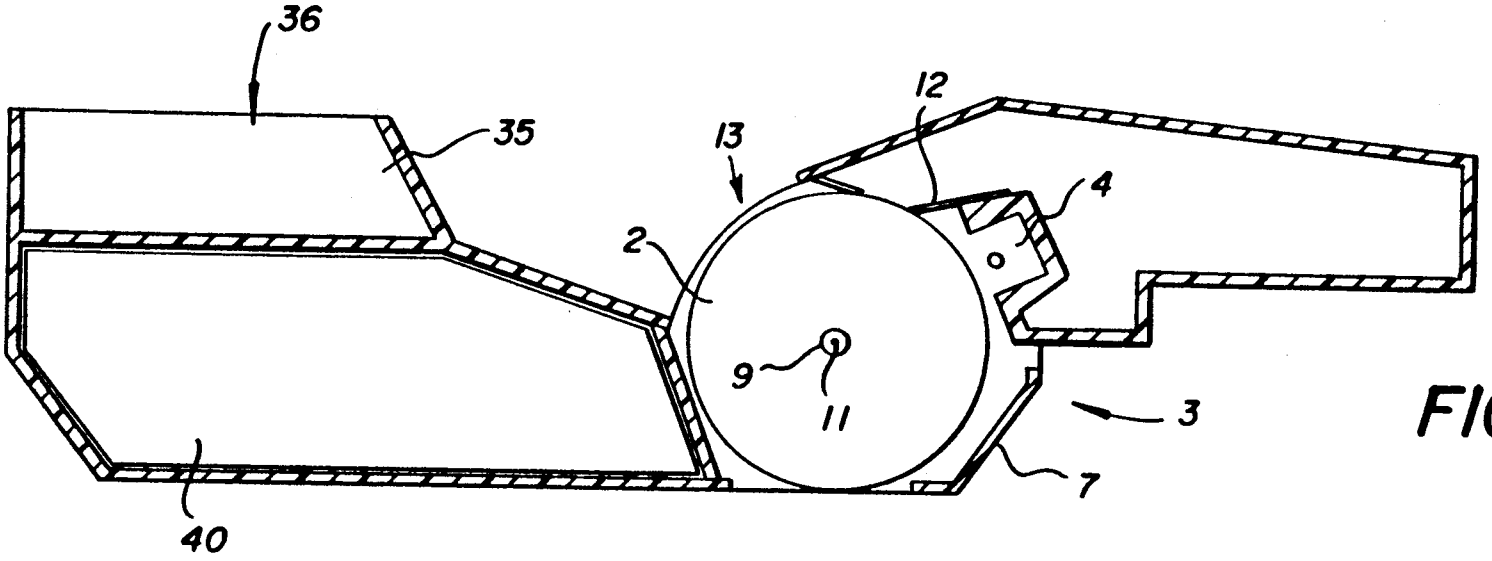
FIG. 5 is a front section of the cartridge shown in FIGS. 2–4.
Figure 6:
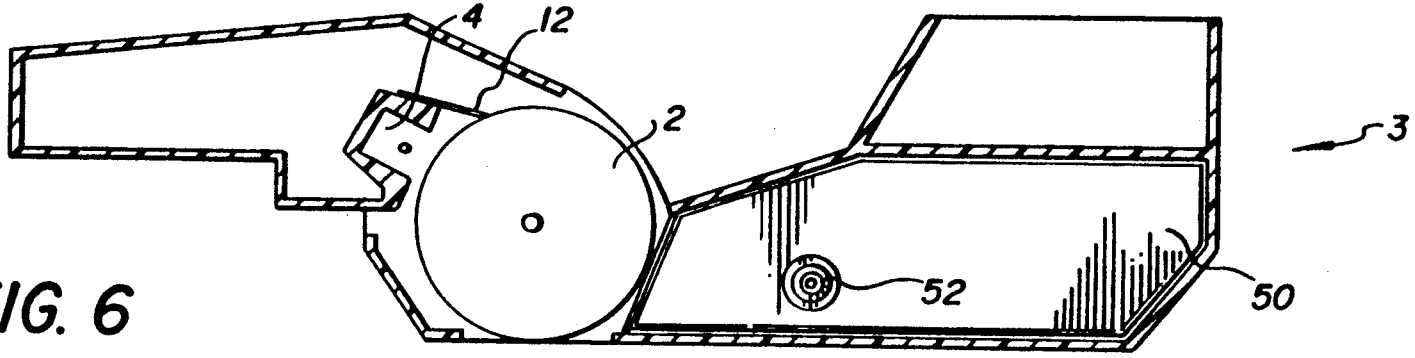
FIG. 6 is a rear view of the cartridge illustrated in FIGS. 2–5 with the rear wall eliminated to illustrate the inner parts of the cartridge.

To easily replace the image member 2, image member 2, charging device 4 and cleaning device 12 are all included in an image member cartridge 3, not shown in FIG. 1 but shown in detail in FIGS. 2–6. Referring especially to FIG. 5, image member cartridge 3 includes photoconductive drum 2, charging device 4 and cleaning device 12 enclosed in a cartridge housing 7. Drum 2 is supported on a shaft 9 for rotation about an axis 11. It is rotatable by engagement with transfer drum 10 (FIG. 1) through a transfer opening 13.

Cartridge 3 also includes a chamber 35 having an opening 36 for receiving toner cleaned off transfer drum 10 by articulatable cleaning device 30.

Cartridge 3 also includes a chamber 40 which holds a source of offset preventing liquid for fuser 23. This feature is best shown in FIGS. 3 and 4. Referring to FIG. 4 offset preventing liquid, for example, silicone oil is contained in a bottle 50 which is snugly insertable endwise into chamber 40 during assembly of cartridge 3. Bottle 50 includes a supply valve 52 which when the bottle 50 is inserted in chamber 40 is located to the rear of cartridge 3. Valve 52 can be a conventional check valve which releases liquid when accessed by a suitable mating receiving valve in the apparatus. As seen in FIG. 3, supply valve 52 extends through a back wall 55 of cartridge 3 when the cartridge is finally assembled.

Figures 7, 8:
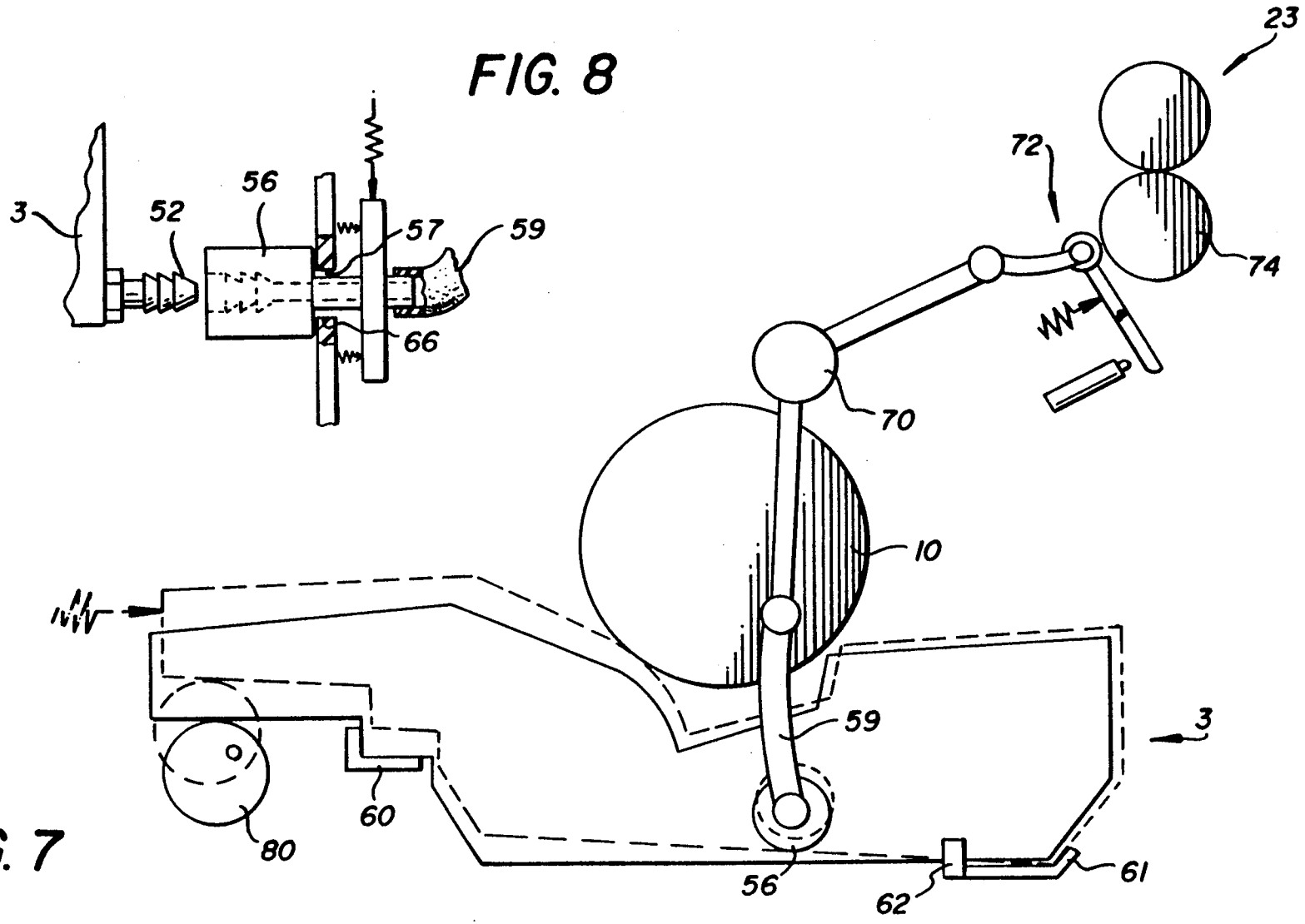
FIG. 7 is a rear view of the cartridge receiving structure with the cartridge shown in phantom in two positions illustrating rotation of the cartridge during cartridge replacement.
FIG. 8 is a cross-section of a receiving valving structure in the receiving apparatus shown in FIG. 7 with the supplying valve structure of the cartridge also shown in the process of being inserted.

As seen in FIG. 7, cartridge 3 is insertable under transfer drum 10 by moving it parallel to the axis 11 (FIG. 5) of image member 2 along guides 60 and 61 in the receiving apparatus until it reaches a stop 62. Before reaching stop 62, supply valve 52 mates with a receiving valve 56 shown in FIGS. 7 and 8, which receiving valve 56 is positioned in a slot 57 in a rear mechanism plate 58 of the image forming apparatus 1. The mating of check valve 52 with receiving valve 56 automatically moves check valve 52 to a open condition allowing offset preventing liquid to flow through receiving valve 56 and into a supply tube 59. Supply tube 59 is connected through a pump 70 to a suitable wicking structure 72 which meters the offset preventing liquid to a fusing surface of a fusing roller 74 which is part of fuser 23. As shown in FIG. 7, wicking structure 72 is a conventional rotating wick which is internally fed as controlled by pump 70. However, it could be a stationary wick having its own reservoir which, in turn, is fed by pump 70. It could also be any other wicking structure to which offset preventing liquid is fed from a reservoir.

Cartridge 3 is rotated by a cam 80 through a rotary spring, not shown, to engage image member 2 with transfer drum 10. The second position of cartridge 3 is shown in phantom in FIG. 7 illustrating rotation of cartridge 3 about guide 61. To absorb a small, largely vertical, movement of supply valve 52 during this rotation of cartridge 3, receiving valve 56 is movably mounted on mechanism plate 58, as shown in FIG. 8. More specifically, receiving valve 56 is spring urged against a lower surface 66 of slot 57, where valve 56 is accurately positioned for receipt of valve 52. As cartridge 3 is rotated, as shown in FIG. 7, valve 52 moves slightly upward, which movement moves valve 56 against such spring urging to whatever final position is arrived at by valve 52. The lower portion of tube 59 is flexible to also permit such movement.

The bottle 50 could be dispensed with by making chamber 40 entirely liquid tight. However, it is more practical to have the bottle supplied with check valve 52 by the manufacturer of the offset preventing liquid and assembled into a cartridge which does not have such a liquid tight requirement.

With this invention, the loading of a single cartridge 3 into printer 1 supplies not only the replaceable image member but also one of the other disposable items of supply. The cartridge also could supply a development station thereby eliminating the need for supply of toner as a separate operator activity. This approach would be preferred if printer 1 were a single color printer. However, in its preferred form as a four-color printer, it is inconvenient to include four toning stations in an image member cartridge. However, each of these alternatives are possible within the full scope of the invention.

With a single color printer, transfer drum 10 would be eliminated and the receiving sheet would receive the toner image directly from image member 2 as is conventional in the art.

The invention has been described in detail with particular reference to a preferred embodiment thereof, but it will be understood that variations and modifications can be effected within the spirit and scope of the invention as described hereinabove and as defined in the appended claims.

I claim:

1. An image forming apparatus comprising:

a replaceable cartridge containing a source of offset preventing liquid and an image member, said image member having an image surface, means for moving said image surface through an endless path past a series of stations for forming a toner image on said image surface, means for transferring the toner image to a receiving sheet, means for fusing said toner images to the receiving sheet, said fusing means including means for applying an offset preventing liquid to a surface of said fusing means, and means for transferring offset preventing liquid from the source of offset preventing liquid in said cartridge to said offset preventing liquid applying means.

2. An image forming apparatus according to claim 1 wherein said image member is a photoconductive drum and said cartridge also includes means for uniformly charging said photoconductive drum.

3. An image forming apparatus according to claim 2 wherein said cartridge includes an access opening through which said image surface is imagewise exposable to form a series of electrostatic images and an access opening through which said electrostatic images are tonable to create a series of toner images.

4. An image forming apparatus according to claim 3 wherein said image forming cartridge includes an access opening through which the series of toner images are transferable in registration by said transfer means to a receiving sheet to form a composite image of said toner images on said receiving sheet.

5. An image forming apparatus according to claim I wherein said transfer means includes a transfer drum to which toner images are transferred and means for transferring a toner image from said transfer drum into a receiving sheet.

6. An image forming apparatus according to claim 1 wherein said source of offset preventing liquid includes a supply valve and said image forming apparatus further includes a receiving valve matable with said supply valve and positioned to mate with said supply valve in response to insertion of said cartridge in said image forming apparatus.

7. An image forming apparatus according to claim 6 including means for rotating a cartridge which has been inserted in said apparatus to move the image member of said cartridge to an operative position and wherein said receiving valve is movable in response to movement of said supply valve as said cartridge is rotated.

8. An image forming apparatus according to claim 7 wherein said supply valve is automatically movable to an open position in response to mating with said receiving valve.

9. An image forming apparatus according to claim 6 wherein said supply valve is automatically movable to an open position in response to mating with said receiving valve.

10. An image forming apparatus comprising:

means for receiving a cartridge containing a source of offset preventing liquid and an image member having an image surface, means for moving said image member through an endless path past a series of stations for forming a toner image on said image member, means for transferring the toner image to a receiving sheet, means for fusing said toner image to the receiving sheet, said fusing means including means for applying an offset preventing liquid to a surface of said fusing means, and means for transporting offset preventing liquid from the source of offset preventing liquid in a received cartridge to said offset preventing liquid supplying means.

11. An image forming apparatus according to claim 10 including a receiving valve connectable with a supply valve of a received cartridge, said receiving valve being positioned to mate with a received supply valve in response to insertion of a received cartridge in said image forming apparatus.

12. An image forming apparatus according to claim 11 wherein said receiving valve is movable in response to movement of said supply valve in a direction generally transverse to movement of said supply valve in its inserting direction.

13. An image member cartridge for insertion in an image forming apparatus, said image forming apparatus being of the type including a fuser and means for applying offset preventing liquid to a surface in said fuser, said image forming cartridge comprising:

an image member movable through an endless path past a series of stations for forming a toner image on said image member for transfer to a receiving sheet where said toner image is fused by the fuser of the image forming apparatus, and a source of offset preventing liquid accessible by an image forming apparatus for use by the means for applying offset preventing liquid to the fuser of such an apparatus.

14. An image member cartridge according to claim 3 wherein said source of offset preventing liquid is a bottle of offset preventing liquid which is held by a housing of said cartridge.

15. An image member cartridge according to claim 13 wherein said source of offset preventing liquid includes means for holding offset preventing liquid and a supply valve for accessing said offset preventing liquid.

16. An image member cartridge according to claim 15 wherein said supply valve is automatically adjustable to an open condition in response to mating with a receiving valve in a receiving image forming apparatus.

17. An image forming cartridge according to claim 13 wherein said source of offset preventing liquid is a bottle held by said cartridge, said bottle having a supply valve which valve is movable to an open condition in response to mating with a receiving valve in a receiving image forming apparatus.

18. An image member cartridge comprising:

a housing, an image member supported by said housing for rotation past a series of stations for forming toner images on said image member, and an accessible source of offset preventing liquid supported by said housing.

19. An image member cartridge according to claim 18 wherein said source of offset preventing liquid is a bottle supported by said cartridge, said bottle having a valve through which said offset preventing liquid is accessible.

20. An image forming cartridge according to claim 19 wherein said valve is adjustable to an open condition in response to mating with a receiving valve.

21. An image member cartridge comprising:

a rotatable photoconductive drum, and a source of offset preventing liquid.

22. An image member cartridge according to claim 21 further including means for uniformly charging a surface of said image member.

23. An image member cartridge according to claim 22 further including an access opening for toning a series of electrostatic images to form a series of toner images and an access opening through which said series of toner images can be transferred in registration to a receiving surface.

24. An image member cartridge according to claim 19 further including an opening in said cartridge for image-wise exposing said image member.

25. An image member cartridge according to claim 24 further including an access opening through which electrostatic images on said image member are tonable to form toner images.

26. An image member cartridge according to claim 21 further including an access opening through which toner images are transferable from said image member to a receiving surface.

27. A photoconductive drum cartridge comprising:

a photoconductive drum rotatable about an axis of rotation which axis of rotation runs from front to rear in said cartridge, and a bottle containing offset preventing liquid and having a valve located in the rear of said cartridge for access to said offset preventing liquid.

* * * * *